US005839870A

United States Patent [19]

Niemirowski et al.

[11] Patent Number: 5,839,870

[45] Date of Patent: Nov. 24, 1998

[54] TRANSFER SYSTEM FOR USE WITH A HORIZONTAL FURNACE

[75] Inventors: George E. Niemirowski, South Lane; Adam F. Niemirowski, Grapevine; John M. Harrell, Waxahachie; P. V. Patel, South Lake, all of Tex.

[73] Assignee: Novus Corporation, Carrollton, Tex.

[21] Appl. No.: 614,868

[22] Filed: Mar. 13, 1996

[51] Int. Cl.[6] ..... F27D 3/06

[52] U.S. Cl. ..... 414/150; 414/156; 414/750; 414/938

[58] Field of Search ..... 414/148, 150, 414/152, 156, 160, 172, 196, 198, 223, 750, 905, 938; 432/239, 253

[56] References Cited

U.S. PATENT DOCUMENTS

| | | | |
|---|---|---|---|
| 4,124,132 | 11/1978 | Pennings | 414/905 X |
| 4,288,192 | 9/1981 | Geiger et al. | 414/223 X |
| 4,439,146 | 3/1984 | Sugita | 414/152 X |
| 4,530,637 | 7/1985 | Mason et al. | 414/750 |
| 4,543,059 | 9/1985 | Whang et al. | 432/239 X |
| 4,669,938 | 6/1987 | Hayward | 414/156 |
| 4,701,096 | 10/1987 | Fisher, Jr. | 414/938 X |
| 4,954,079 | 9/1990 | Yamaga | 432/253 X |
| 5,069,591 | 12/1991 | Kinoshita | 432/253 X |
| 5,123,804 | 6/1992 | Ishii et al. | 414/736 X |
| 5,131,799 | 7/1992 | Nishi et al. | 414/938 X |

*Primary Examiner*—James W. Keenan
*Attorney, Agent, or Firm*—David H. Judson

[57] ABSTRACT

An apparatus for preventing the cross contamination of heating element within horizontal furnaces is disclosed. A rotating spindle may connect to either or both of the lifting arm of a triaxial loader or the transfer plate of a loading station. A pair of spindles are able to lift a single wafer boat. Each spindle includes a plurality of active positions with one active position associated with each heating element of the horizontal furnace. A control processor monitors the position of the spindle and rotates the spindle to the active position associated with a heating element when a loading or unloading process is initiated for that heating element.

17 Claims, 7 Drawing Sheets

TRANSFER SYSTEM FOR USE WITH A HORIZONTAL FURNACE

TECHNICAL FIELD

The present invention relates to wafer manufacturing processes, and more particularly to a system for transferring boats containing process ready wafers between a work station and a horizontal furnace.

BACKGROUND OF THE INVENTION

The processing of semiconductor materials, such as silicone, many times involves the heating of wafers of the semiconductor material to provide the material with desired properties. Heating of the semiconductor material is required for oxidation, metallization, doping and a variety of other processes.

Heating requires the placement of a boat load of silicon wafers into a furnace area of a desired temperature. Once the wafers are heated to the desired temperature, the boat of wafers is removed from the furnace. A typical furnace assembly includes a multiplicity of horizontally oriented quartz tubes arrayed vertically one above the other, inside an overall heating element. Normally, a triaxial loader transfers the boats from a loading station into the furnace for heating and from the furnace to the working area upon completion of the heating.

Horizontal furnaces may use different gasses and materials within the different furnace areas to achieve desired properties for the semiconductor material. When the triaxial loader, utilizes the same manipulator arm contact surfaces to remove the wafer carrying boats from a furnace, cross-contamination between furnaces using different types of gasses or materials may result. This contamination can greatly affect the desired properties of the semiconductor wafer material and may contaminate a boat load of wafers, making them completely useless.

Presently existing methods for controlling this contamination include performing only a single type of process within all heating elements of the horizontal tube furnace assembly or using less than the full number of heating elements on a single process. These methods limit the efficiency of semiconductor production and can cost a manufacturer hundreds of thousands of dollars. Thus, a triaxial loader transfer system capable of substantially reducing the possibility of contamination between adjacent heating element areas would greatly benefit the production of semiconductor materials.

BRIEF SUMMARY OF THE INVENTION

The present invention overcomes the foregoing and other problems with an improved apparatus for transferring containers between a loading station and a horizontal furnace. The apparatus comprises additions to an existing triaxial loader and loading station system wherein a pair of rotating spindles are attached to the lifting arms of the triaxial loader and to the transfer plate of a loading station. The spindles may then be used to move wafer boats between positions.

The spindles include a plurality of active positions, each of the positions uniquely associated with one of the heating elements of the horizontal furnace. In this manner, wafer boats from a particular heating element always come in contact with the same portion of the spindle, limiting the possibilities of cross-contamination. The spindle assembly includes actuation means for rotating the spindle in multiple position increments and then locking it into position. Detectors monitor the position of the spindle and determine which position is active so that a controller may control the positioning of the spindle, thus insuring that during loading and unloading operations the proper active position associated with the heating element being loaded or unloaded is used.

The foregoing has outlined some of the more pertinent aspects of the present invention. These aspects should be construed to be merely illustrative of some of the more prominent features and applications in the invention. Many other beneficial results can be attained by applying the disclosed invention in a different manner or modifying the invention as will be described. Accordingly, other aspects and a fuller understanding of the invention may be had by referring to the following detailed description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION

Figure 1:
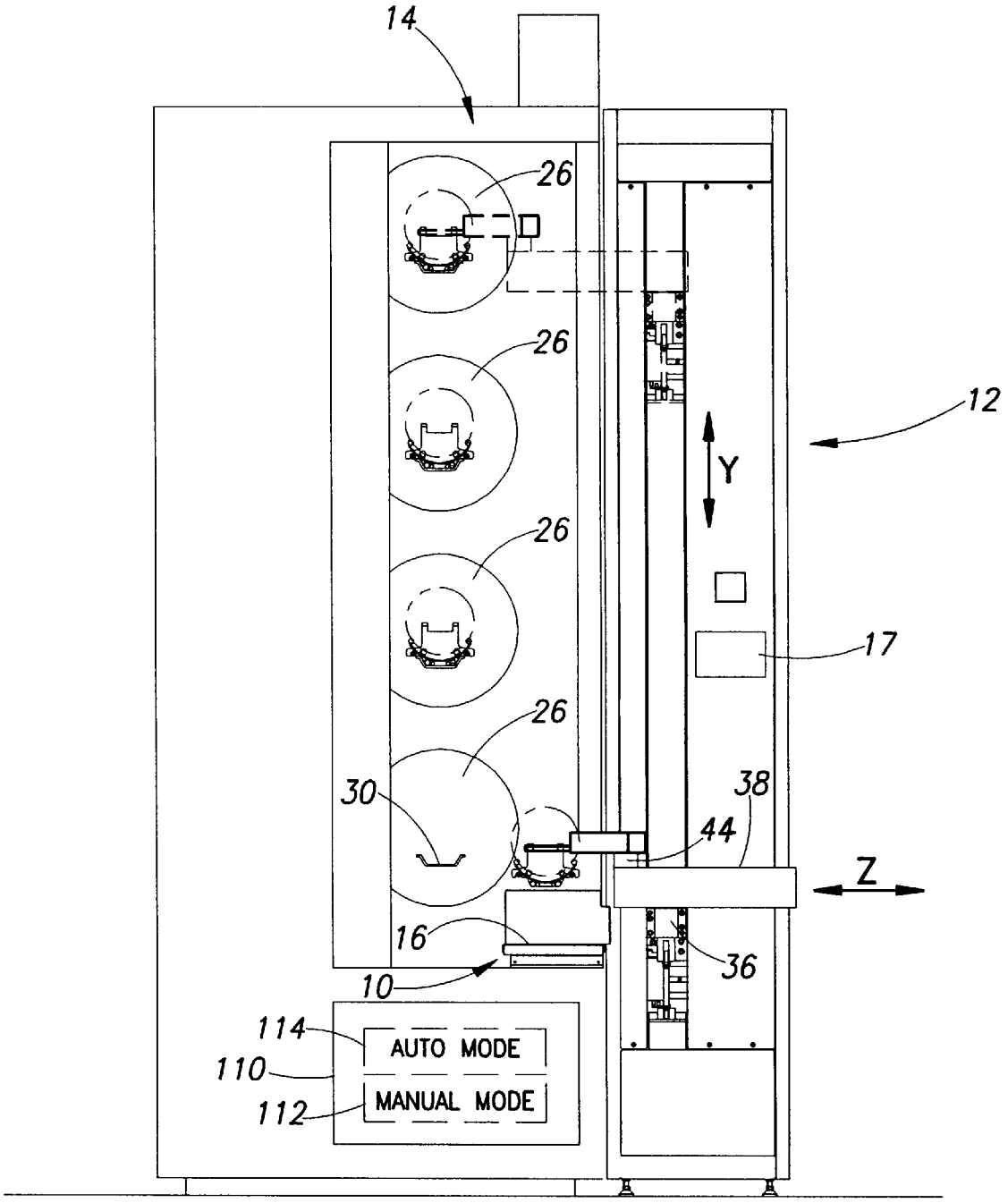
FIG. 1 is an end view of a wafer boat transfer system of the present invention.
Figure 2:
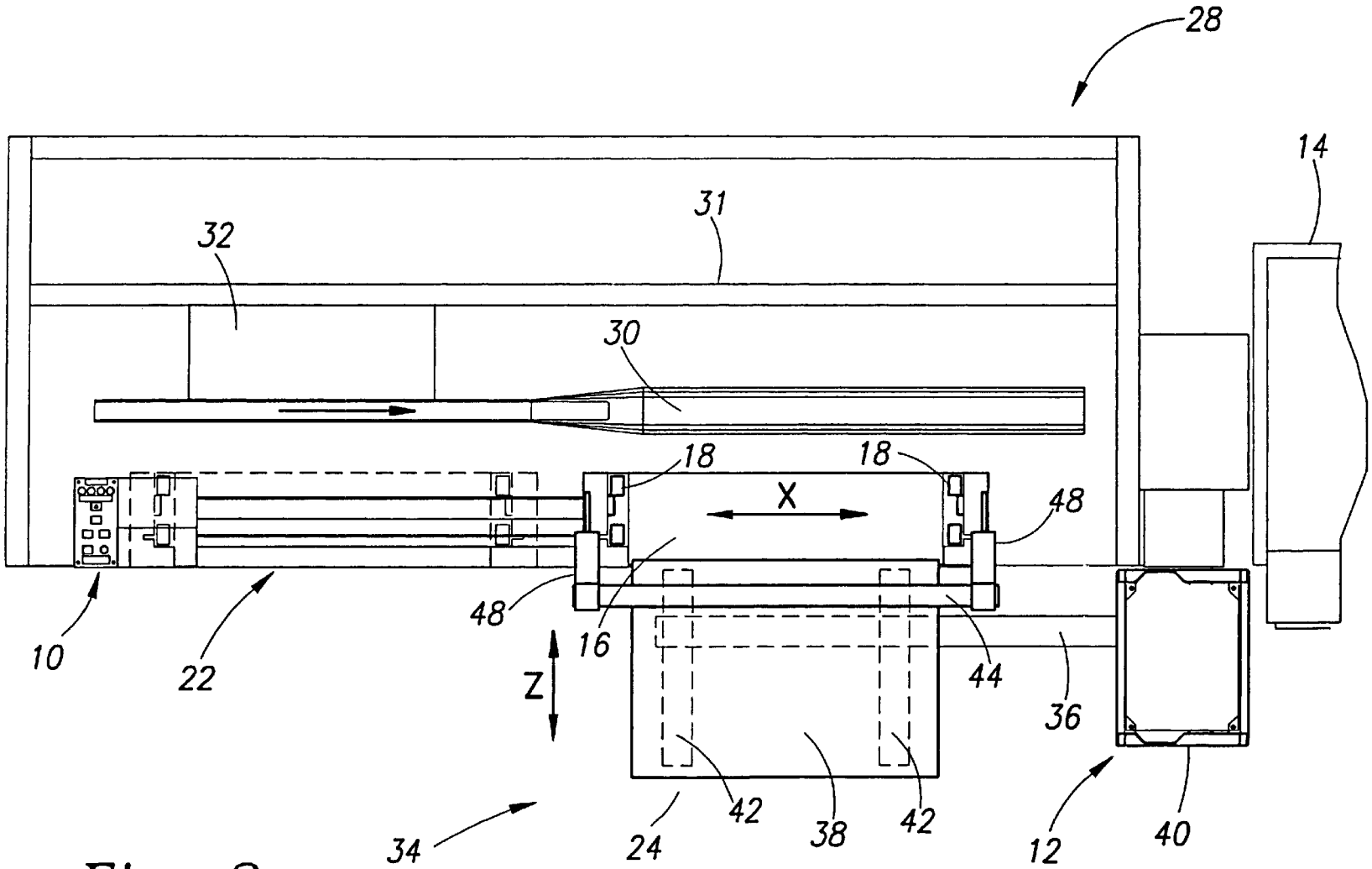
FIG. 2 is a top view of the wafer boat transfer system of FIG. 1.

Referring now to FIGS. 1 and 2, the system consists of a loading station 10, triaxial loader 12, and horizontal tube furnace 14. The loading station 10, shown in FIG. 3, consists of a transfer plate 16 having a pair of loading station spindles 18 for receiving a wafer boat. The loading station spindles 18 rotate to four distinct positions. Each position is uniquely associated with a particular heating element 26. The structure of the track system spindles 18 will be more fully discussed later. Within at least one of the track system spindles 18 is a sensor 78 for detecting when an intermediate carrier 75 is loaded on the transfer plate 16. The transfer plate 16 is driven by a drive mechanism (not shown) between a loading point shown in phantom at 22 and a work station shown generally at 24 where the intermediate carrier 75 is removed from the transfer plate 16 by the triaxial loader 12. A triaxial loader 12 is capable of moving objects along three axes X, Y and Z as illustrated in the figures. The loading of boats of processed wafers onto the transfer plate 16 at the loading point 22 is performed manually by an operator.

The furnace assembly 14 is a four-stack array of horizontal heating elements 26. Each tube and heating element 26 comprises a separate unit which may utilize different gasses and materials. Wafer boats are loaded into the furnace tubes 26 using a loading system 28. The loading system 28 includes a rack 31 having four cantilever paddles 30. Each paddle 30 is associated with one of the furnace tubes 26. A driver 32 drives the paddle 30 in a horizontal direction to facilitate the movement of wafer boats placed on the paddle into and out of a furnace tube 26.

The triaxial loader 12 transfers wafer boats between the loading station 10 and the furnace 14 using a carriage and slide assembly 34. The carriage and slide assembly 34 preferably utilizes stepper motors (not shown) for the movement along Z and Y axes. The carriage and slide assembly 34 consists of a raising member 36 that moves the carriage and slide assembly 34 up and down along the Y axis and a sliding mechanism 38 for moving an intermediate carrier 75 in the horizontal direction along the Z axis. In an alternative embodiment which is not shown, movement in the Z axis direction may be accomplished using a swing mechanism which moves a boat in an arcuate motion toward and away from the raising member 36. The raising member 36 extends directly from the triaxial loader body 40. One of the stepper motors on the triaxial loader 12 drives a boss screw (not shown) connected to the raising member 36 for the up/down (Y axis) movement.

The other stepper motor controls the in/out (Z axis) movement of the sliding mechanism. The stepper motors are driven by a motor controller and motor driver located in the base of the triaxial loader 12. The slide mechanism 38 consists of a pair of slides 42 mounted on the raising member 36 and a crossbar 44 interconnecting the spindle assemblies 48. A triaxial loader spindle 48, similar to the loading station spindles mentioned previously, is mounted to each end of the crossbar 44, in such a way that a wafer boat may be held between them. The triaxial loader spindle 48 will be more fully discussed later.

An electric brake mounted along the Y axis prevents any triaxial loader motion in event of a power failure. Furthermore, a pair of sensors limit the extreme positions of travel for the carriage and slide assembly 34. A plurality of optical sensors mounted along each motion axis are utilized during a homing routine to position the loading arm when the machine is initialized and during triaxial loader 12 operation to verify position. An optical sensor on the load arm verifies the presence of the intermediate carrier 75 at either a furnace or work station site.

Figure 4:
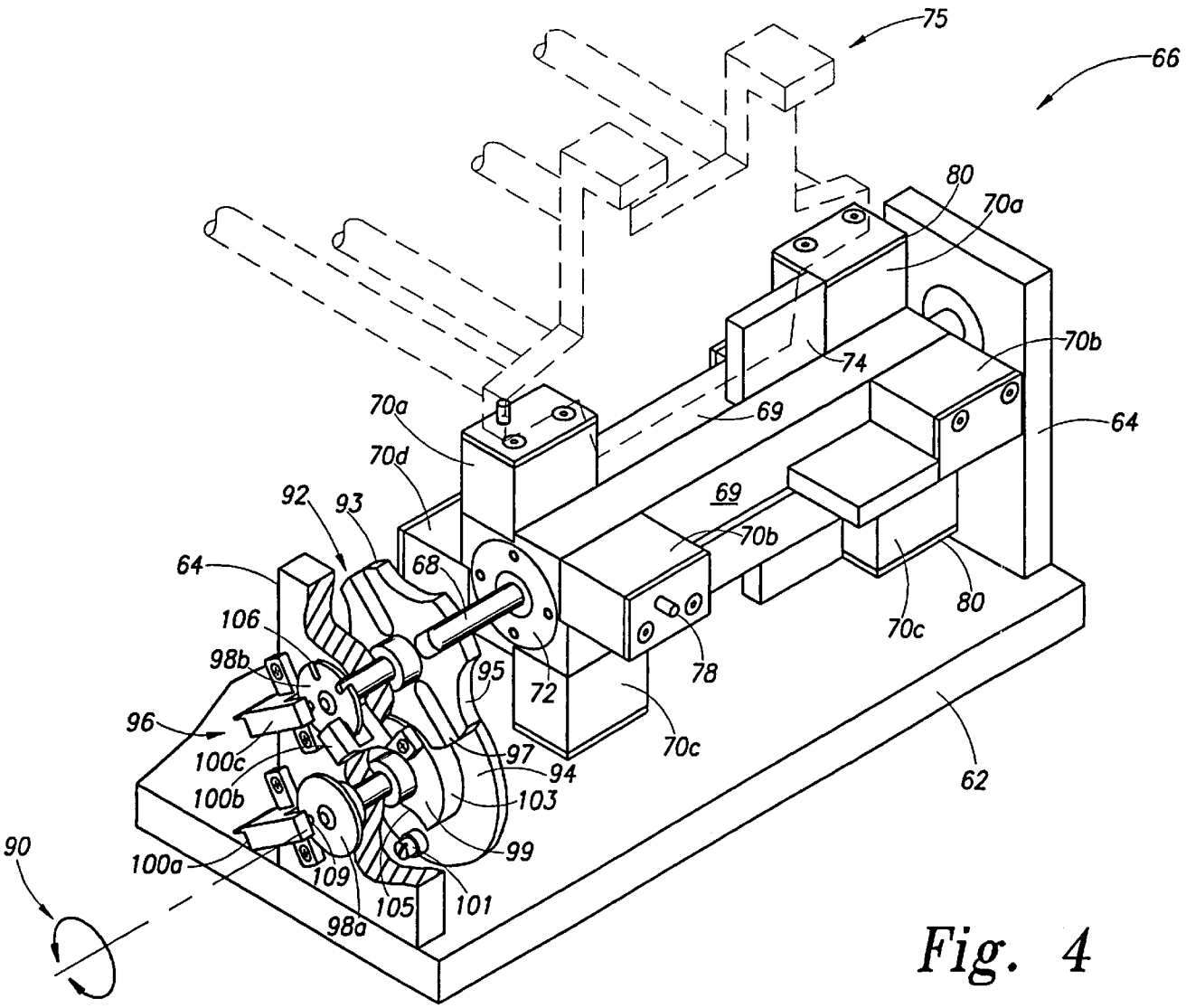
FIG. 4 is a perspective view of one embodiment of a rotating spindle.

A first embodiment of the track system 10 and track system spindle assembly 18 is more fully illustrated in FIG. 4. The spindle 66 is mounted to a base 62 which is part of the track system transfer plate 16. The base 62 includes a pair of flanges 64 onto which a rotating spindle 66 is mounted via a shaft 68. The spindle 66 may be rotated to one of four positions for supporting a boat. The boat is resting on blocks (70*a*,70*b*,70*c* & 70*d*) which are mounted on corresponding ledges 69, which are in turn mounted on a central rotating member 72 which is mounted on shaft 68. Each pair of blocks 70 defines a position associated with a particular heating element tube 26. A carrier stop 74 prevents the wafer boat 75 from extending past the block pair 70 of the spindle 66. A detector 78 on the surface of one of each pair of blocks 70 detects the presence of a wafer boat to enable transfer operations. Each block 70 further includes a boat support pad 80 made of a temperature resistant material sufficient to resist the high temperature of a quartz boat 75.

Figure 5:
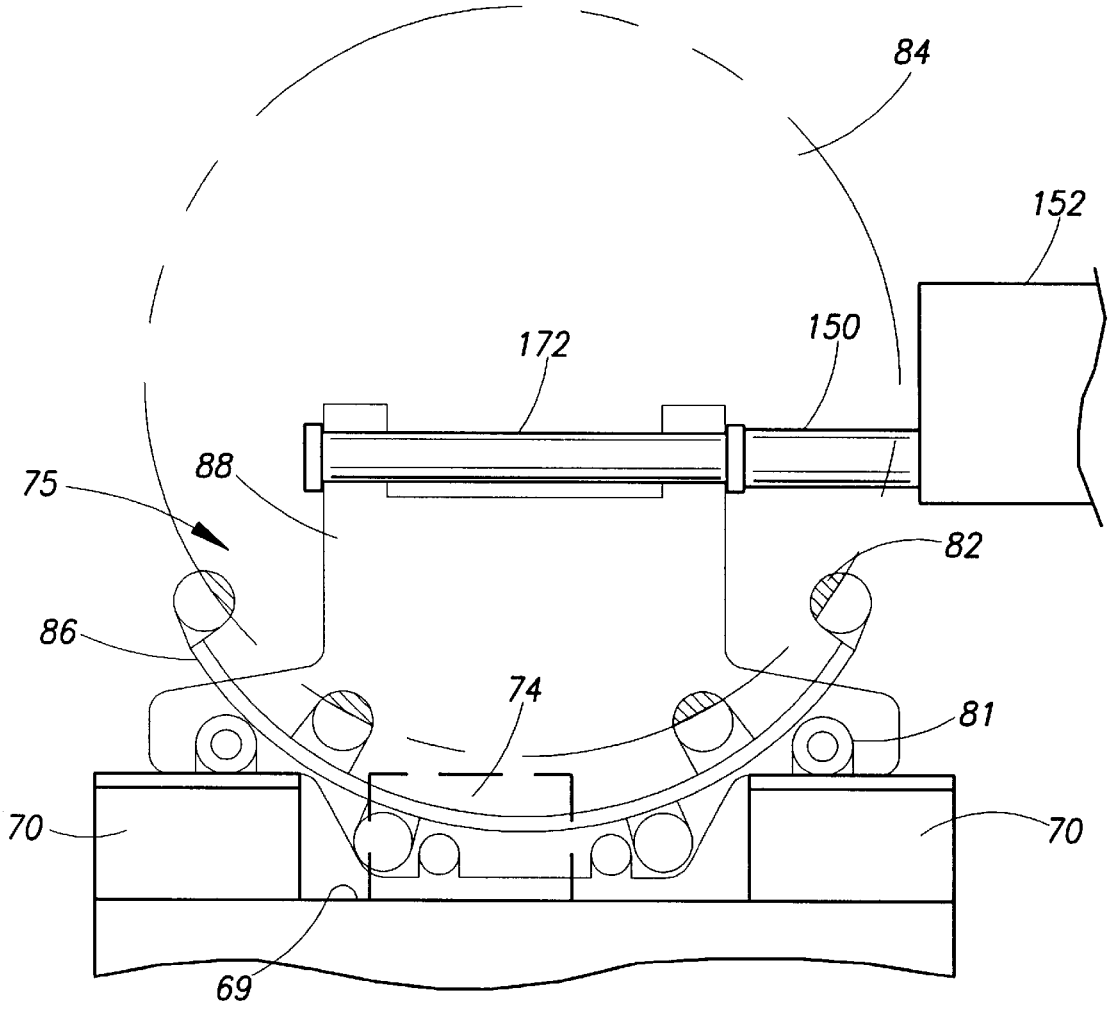
FIG. 5 is an end view of a wafer boat sitting on a rotating spindle.
Figure 6:
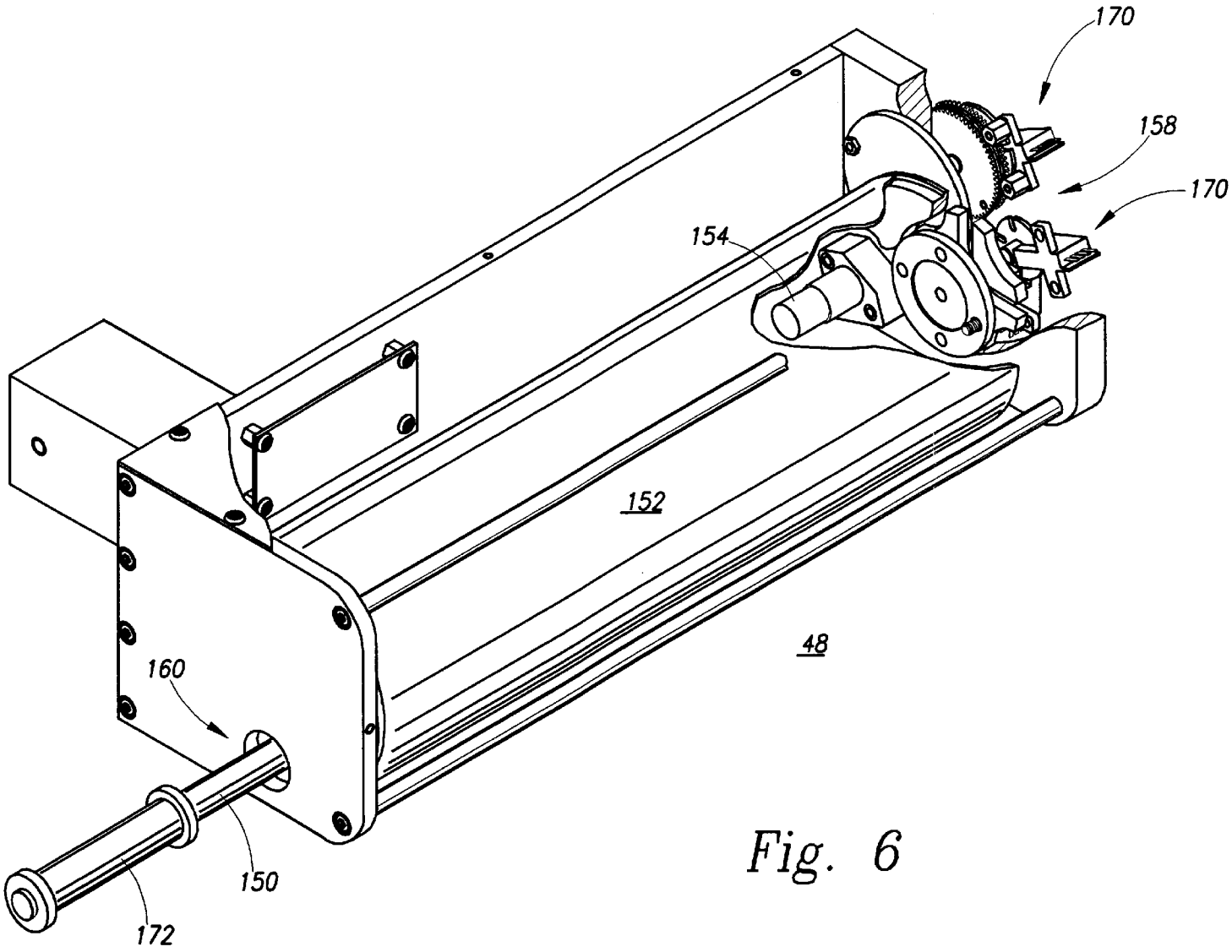
FIG. 6 is a perspective view of a second embodiment of a rotating spindle.

Referring now also to FIG. 5, there is illustrated the manner in which a wafer boat 86 interacts with the spindle 66. A wafer boat 86 includes a number of slots 82 for holding a plurality of silicon wafers 84. The wafer boat 86 is placed upon the rails 81 of a quartz intermediate carrier 75 having an end plate 88 that rests on one pair of support blocks 70, while not touching the ledge 69 of central portion 72. The carrier stop 74 prevents the intermediate carrier 75 from moving laterally. When an intermediate carrier 75 is supported at each end by a quartz gripper 172, the intermediate carrier 75 and wafer boat 86 (referred to collectively as the boat) may be lifted onto a furnace paddle 30, by the triaxial loader spindle 48 (FIG. 6). When supported by the track system spindle 18, it can be moved by the transfer plate.

A drive mechanism (functionality shown as 90) enables a spindle 66 to be rotated by a desired interval and locked into a selected position. Shown is a quarter turn geneva 92 and full turn geneva 94 which provide rotation of the spindle 66 in quarter turn increments. While the present invention is described using quarter and full turn genevas, it should be realized that other types of genevas or mechanically linked drive mechanisms could be utilized. The quarter turn geneva 92 is a planar disk having four arm portions 93 extending at 90 degree angles from each other. Between each arm portion 93 is a concave surface 95. Within the center of each arm is a slot 97 radiating toward the center of the quarter turn geneva 92. The full turn geneva 94 consists of a circular disk having a crescent shaped block 99 and a post 101 on one side thereof for engaging the slots of the quarter turn geneva 92.

The full turn geneva 94 is driven by a drive means (functionality shown as 90) and as the geneva rotates, a convex surface 103 of the crescent shape block 99 engages a concave surface 95 on the quarter turn geneva 92. This enables the full turn geneva 94 to rotate while locking the position of the quarter turn geneva 92 in place. This would be the position used when the active position was set and further rotation was not required As the full turn geneva 94 completes a revolution, the post 101 engages one of the slots 97 of the quarter turn geneva 92 causing the quarter turn geneva to rotate 90 degrees. This rotation is enabled by the arms 93 rotating through the concave portion 105 of the crescent shaped block 99 in response to a slot's engagement with the post 101. Once the desired position is achieved, the full turn geneva 94 continues to rotate until the post 101 disengages slot 97 and the convex portion 103 of the crescent shaped block 99 engages the quarter turn geneva 92 and locks it in position.

A sensor mechanism 96 is connected to the shaft of each geneva 92 and 94. The sensor mechanism 96 consists of a detector shutter 98 on each geneva and three IR detectors 100 to enable a determination of the active position of the spindle 66. The detector shutter 98*a* connected to the full turn geneva 94 includes a single slot 109 for actuating the IR detector 100*a* to generate a signal indicating the spindle 66 has rotated to one of the four active positions for receiving a wafer boat. Detector shutter 98*b* includes four slots 106 that are located at non-ninety degree positions. A pair of IR detectors 100*b* and 100*c* monitor detector shutter 98*b* for the slots. The IR detectors 100*b* and 100*c* detect four conditions: off/off; off/on; on/off; on/on. Each of these detection conditions are associated with one of the four active positions of the spindle 66 so a control processor 110 may determine which position is currently active.

Figure 7:
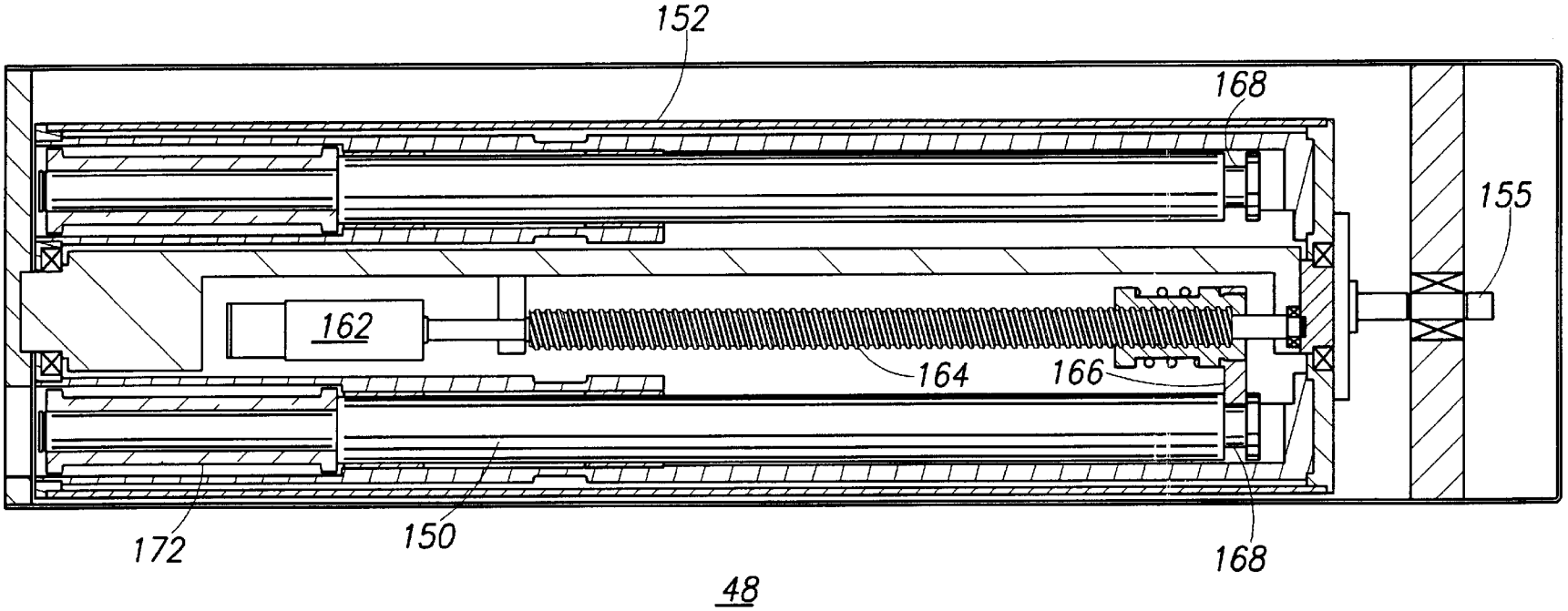
FIG. 7 is a cross-sectional view of the embodiment of FIG. 6.

Referring now to FIGS. 6 and 7, there is illustrated the triaxial loader spindle 48. The triaxial loader spindle 48 includes a mechanism mounted to the end of crossbar 44. The triaxial loader spindle 48 includes four extensible fingers 150, including high temperature quartz grippers 172, within a rotating cylinder 152. Each of the extensible fingers 150 is associated with one of the heating element tubes 26 of the horizontal furnace 14 to prevent cross-contamination between heating element tubes 26.

Figure 3:
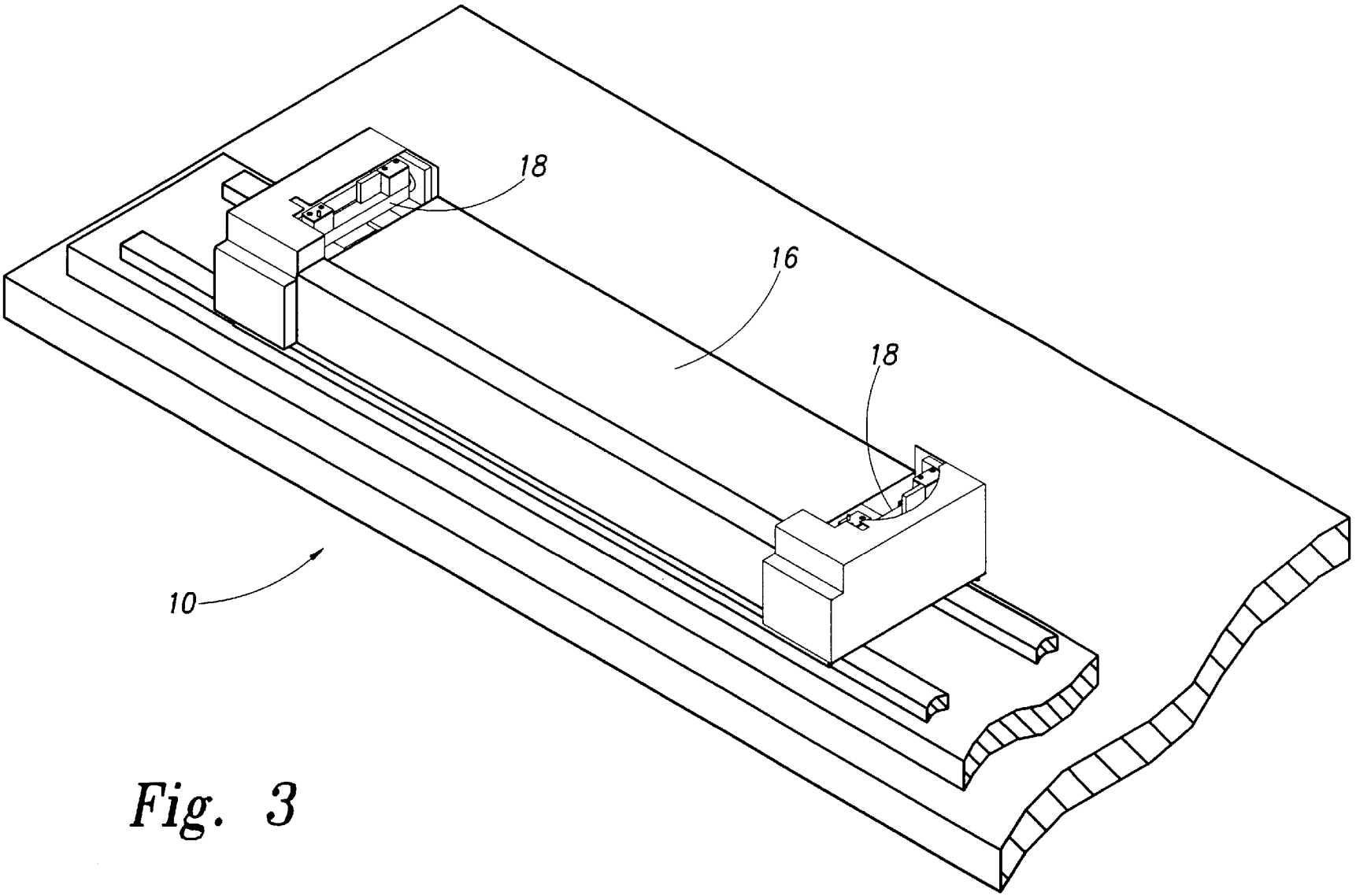
FIG. 3 is a perspective view of the loading station.

A drive means 154 rotates the cylindrical portion 152 about a central stem 155 using a drive mechanism 158 similar to that discussed with respect to the track system spindle assembly 18 of FIG. 3. The drive mechanism 158 rotates the cylinder 152 in quarter turn increments to position an extensible finger 150 at a bottom position as shown generally at 160 for lifting a wafer boat. A drive motor 162 within the rotating cylinder 152 rotates a drive screw mechanism 164 that extends and retracts a tongued driver 166 that engages a slot 168 within the lower most extensible finger 150. The tongued driver 166 is positioned to engage the slot of each extensible finger 150 as the finger is rotated to the lower most position of the triaxial loader spindle 48. As with the track system spindle assembly 18, a sensor mechanism 170 provides information to the control processor 110 to indicate the presently active extensible finger 150 of the elevator spindle.

The control processor 110 controls the operation of the triaxial loader 12 and track system 10 to enable transfer of wafer carriers to and from the furnace 14. The control processor 110 is illustrated as being located within the track system 10 but may actually be located at any location internal or external to the system. The control processor 110 has an auto mode 112 and a manual mode 114. The manual mode 112 enables teaching to the system necessary data required to perform the loading and unloading operations. Initially, a user manually places the carriage and slide assembly 34 in a home position that the control processor 110 memorizes. Next, the location of each landing site for the heating element tubes 26 is taught to the system as well as the location of the track system 10. In the manual mode 114, an operator also defines variables including movement velocities and triaxial loader pick and place speeds.

The auto mode 112 utilizes the data taught to the control processor 110 during the manual mode 114 to allow automatic transfer of wafer boats. After selecting the auto mode 112, an operator may place a boat of process ready wafers at the track system 10 and then through a series of key strokes on the external key pad 17, the control processor 110 instructs the triaxial loader 12 to start a loading or unloading sequence. The control processor 110 also tracks the position of the spindles such that the track system spindles 18 and triaxial loader spindles 48 are rotated to the active position associated with the heating element 26 that an intermediate carrier is loading to, or unloading from. The control processor 110 knows which position a spindle 66 is in based upon the signals from the IR detectors 100 of the sensor mechanism 96.

When an operator initiates a loading or unloading procedure, the carriage and slide assembly 34 initially rests in a home position established in the manual mode. The spindles on the track system 10 and triaxial loader 12 are rotated to the active position associated with the heating element 26 selected by the operator to be loaded or unloaded to prevent cross-contamination. An intermediate carrier 75 manually loaded by an operator is transferred to the work station and the carriage and slide assembly 34 is lowered to the track system 10. Upon reaching the track system 10, a sensor determines the presence of an intermediate carrier 75 at the track system 10 and, upon detection, extends the slide mechanism 38 and extensible fingers 150 to engage the intermediate carrier 75 at the track system 10. After the intermediate carrier 75 is engaged, the load arm 36 is raised to the selected heating element tube 26 and the slide mechanism 38 extends to transfer the intermediate carrier 75 from the triaxial loader 12 to the paddle 30 for the selected position. Upon completion of heating of the wafers, the procedure is reversed to transfer the intermediate carrier 75 from a heating element tube 26 to the track system 10.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

We claim:

1. An apparatus for transferring containers to multiple furnaces that substantially reduces a risk of cross-contamination between furnaces, comprising:

means for holding a container, said means for holding having a plurality of distinct positions for holding the container, each of the distinct positions associated with one of the multiple furnaces, wherein the means for holding comprises:

a base; and a spindle rotatable mounted to the base such that rotation of the spindle in 1/n increments presents n separate distinct positions for holding a container;

means for actuating the means for holding between the plurality of n separate distinct positions;

means for monitoring the means for holding to determine a presently active distinct position and for generating a signal indicating the active distinct position; and a controller for activating the means for actuating to move to the n distinct position associated with a furnace in response to a request for an operation involving the furnace and the signal indicating the active distinct position.

2. The system of claim 1 wherein the spindle further comprises:

a central portion rotatably mounted to the base and defining a plurality of faces for supporting a first portion of the container;

a plurality of pairs of support columns connected to each of the plurality of faces to support a second portion of the container.

3. The apparatus of claim 2 wherein the spindle further comprises:

a cylinder rotatably mounted to the base and defining a plurality of cavities therein;

a plurality of extensible fingers slidably mounted within the plurality of cavities of the cylindrical portion; and drive means for extending the lower most extensible finger to hold a container.

4. The apparatus of claim 2 further including a plurality of back stops connected to each of the plurality of faces for preventing lateral movement of a container.

5. The apparatus of claim 1 further including means for detecting a presence of the container at one of the plurality of distinct positions.

6. An apparatus for transferring containers to multiple furnaces that substantially reduces a risk of cross-contamination between furnaces, comprising:

means for holding a container said means for holding having a plurality of distinct positions for holding the container each of the distinct positions associated with one of the multiple furnaces;

means for actuating the means for holding between the plurality of distinct positions, wherein the means for actuating comprises:

a fall turn geneva having a first position and a second position; and a 1/n geneva responsive to the full turn geneva for rotating 360/n degrees when the full turn geneva rotates through the first position and for remaining in a locked position when the full turn geneva rotates through the second position;

means for monitoring the means for holding to determine a presently active distinct position and for generating a signal indicating the active distinct position; and a controller for activating the means for actuating to move to the distinct position associated with a furnace in response to a request for an operation involving the furnace and the signal indicating the active distinct position.

7. The apparatus of claim 6 wherein the means for monitoring comprises:

a first detector shutter mounted to the quarter turn geneva and defining four slots therein;

a second detector shutter mounted to the full turn geneva and defining a single slot therein;

a detector for monitoring for the slot in the second detector shutter and generating a signal when the slot is detached;

a pair of detectors for monitoring for the slots in the first detector shutter and generating a signal in accordance therewith.

8. A system for transferring a boat to and from a horizontal furnace, comprising:

a plurality of transfer plates each uniquely associated with a furnace tube, wherein each transfer plate is adapted for inserting the boat into the furnace tube;

a triaxial loader for moving the boat from a first position to one of the plurality of transfer plates associated with a furnace tube in the horizontal furnace;

first means, connected to the triaxial loader, for holding the boat during movement between the first position and one of the plurality of transfer plates, wherein the first means for holding moves between a plurality of distinct positions for holding a boat, each of the distinct positions uniquely associated with one of the furnace tubes;

a transfer means for moving the boat from a loading position to the first position; and second means, connected to the transfer means, for holding the boat during movement from the loading position to the first position, wherein the second means for holding moves between a plurality of distinct positions for holding a boat, each of the distinct positions uniquely associated with one of the furnace tubes.

9. The system of claim 8 wherein the first and the second means for holding each comprise:

means for actuating the first and the second means for holding between the plurality of distinct positions; and means for monitoring the first and second means for holding to determine a presently active distinct position and for generating a signal indicating the active distinct position.

10. The system of claim 9 further including a controller for activating the means for actuating to activate a position associated with a furnace in response to a request for an operation involving the furnace and the signal indicating the active distinct position of the first and second means for holding.

11. The system of claim 9 wherein the first and the second means for holding each comprise:

a base; and a spindle rotatably mounted to the base such that rotation of the spindle in 1/n increments presents n separate distinct positions for holding a boat.

12. The system of claim 11 wherein the spindle of the second means for holding further comprises:

a central portion rotatably mounted to the base and defining a plurality of faces for supporting a first portion of the boat; and a plurality of pairs of support columns connected to each of the plurality of faces to support a second portion of the boat.

13. The system of claim 12 further including a plurality of back stops connected to each of the plurality of faces for preventing lateral movement of a boat.

14. The apparatus of claim 11 wherein the spindle further comprises:

a cylinder rotatably mounted to the base and defining a plurality of cavities therein;

a plurality of extensible fingers slidably mounted within the plurality of cavities of the cylindrical portion; and drive means for extending the lower most extensible finger to hold a container.

15. The system of claim 9 further including means for detecting a presence of the container at one of the plurality of distinct positions.

16. The system of claim 9 wherein the means for actuating comprises:

a full turn geneva having a first position and a second position; and a 1/n geneva responsive to the full turn geneva for rotating 360/n degrees when the full turn geneva rotates through the first position and for remaining in a locked position when the full turn geneva rotates through the second position.

17. The system of claim 16 wherein the means for monitoring comprises:

a first detector shutter mounted to the quarter turn geneva and defining n slots therein;

a second detector shutter mounted to the full turn geneva and defining a single slot therein;

a detector for monitoring for the slot in the second detector shutter and generating a signal when the slot is detached;

a pair of detectors for monitoring for the slots in the first detector shutter and generating a signal in accordance therewith.

* * * * *